US009568178B2

(12) United States Patent
Li

(10) Patent No.: US 9,568,178 B2
(45) Date of Patent: Feb. 14, 2017

(54) SOCKET AND PLUG FOR LOAD-BEARING SUSPENDED LAMP

(71) Applicant: Fuhong Li, Beijing (CN)

(72) Inventor: Fuhong Li, Beijing (CN)

( * ) Notice: Subject to any disclaimer, the term of this patent is extended or adjusted under 35 U.S.C. 154(b) by 0 days.

(21) Appl. No.: 14/944,232

(22) Filed: Nov. 18, 2015

(65) Prior Publication Data

US 2016/0069556 A1 Mar. 10, 2016

Related U.S. Application Data

(63) Continuation-in-part of application No. PCT/CN2014/000751, filed on Aug. 6, 2014.

(30) Foreign Application Priority Data

Aug. 29, 2013 (CN) ..... 2013 1 0382671

(51) Int. Cl.

| | |
|---|---|
| ***H01R 33/02*** | (2006.01) |
| ***H01R 33/08*** | (2006.01) |
| ***F21V 23/06*** | (2006.01) |
| ***H01R 33/76*** | (2006.01) |
| ***F21V 21/112*** | (2006.01) |
| ***H01R 13/52*** | (2006.01) |
| ***F21V 21/03*** | (2006.01) |

(52) U.S. Cl.

CPC ..... *F21V 23/06* (2013.01); *F21V 21/03* (2013.01); *F21V 21/112* (2013.01); *H01R 13/5202* (2013.01); *H01R 33/7607* (2013.01)

(58) Field of Classification Search

CPC ..... F21V 23/06; F21V 21/112; F21V 21/03; H01R 13/5202; H01R 13/52; H01R 33/7607

USPC ..... 439/230

See application file for complete search history.

(56) References Cited

U.S. PATENT DOCUMENTS 6,780,049 B1 * 8/2004 D'Angelo ..... F04D 29/601 439/313

* cited by examiner

*Primary Examiner* — Javaid Nasri

(74) *Attorney, Agent, or Firm* — Wayne & King LLC

(57) ABSTRACT

The present invention discloses a weight-bearing socket and plug for a pendent lamp, and the pendent lamp can be installed and disassembled only by inserting or unscrewing the plug. The key point of the technical solution is: The linear transverse beam 8 is installed to the ceiling, and an earth wire can be connected to the screw 801; a wiring button is pressed for connecting a power line; the socket is installed to the transverse beam by using the bolt 9; the pendent lamp and the plug are assembled; the conducting wire is connected to the wiring terminal 10*e*; the plug positioning groove 12*b*1 is aligned with the positioning mark 101 of the socket and is inserted: the weight-bearing pin 3 is inserted into the pin clamping groove 12*a*1 and the lock tongue 6 is inserted into the lock tongue clamping groove; the binding post slider 5*i* is contracted inwards; the binding post 5*a* is pushed to move downwards and come into contact with the wiring vertical column 10*d* of the plug for realizing installation and electrical connection of the pendent lamp: the lock core 13*b* is pressed to push the lock tongue into the socket; the plug is rotated; the weight-bearing pin slides along the ramp 12*a*2; and when the positioning frustum 12*b*4 moves to the destination of the arc-shaped rotating positioning groove 115, the weight-bearing pin is contracted into the socket so the lamp can be disassembled.

10 Claims, 17 Drawing Sheets

A—A

A—A

SOCKET AND PLUG FOR LOAD-BEARING SUSPENDED LAMP

CROSS-REFERENCE TO RELATED APPLICATIONS

This application is a continuation-in-part of International Patent Application No. PCT/CN2014/000751 with an international filing date of Aug. 6, 2014, designating the United States, now pending, and further claims priority benefits to Chinese Patent Application No. 201310382671.4 filed Aug. 29, 2013. The contents of all of the aforementioned applications, including any intervening amendments thereto, are incorporated herein by reference.

TECHNICAL FIELD

The present invention relates to a socket and a plug, in particular to a weight-bearing socket and plug for a pendent lamp.

BACKGROUND OF THE PRESENT INVENTION

In daily life, whether the pendent lamp is installed on a ceiling or a junction box pre-embedded into the ceiling, one lamp is installed individually and one lamp is wired individually, causing that installation, replacement or maintenance of the pendent lamp is inconvenient.

SUMMARY OF THE PRESENT INVENTION

A technical problem to be solved by the present invention is to provide a weight-bearing socket and plug for a pendent lamp, wherein the socket can be preassembled and wired to the ceiling and the plug and the pendent lamp are wired and assembled. As long as the plug is inserted into the socket, installation and electrical connection of the pendent lamp are finished. As long as the locking is released and the plug is screwed off, the pendent lamp can be disassembled. Convenience is provided for installation, replacement and maintenance of the pendent lamp.

The technical solution adopted by the present invention for solving the technical problem is to provide a weight-bearing socket for a pendent lamp, and a plug matched therewith. The socket comprises a socket base (1), a central column (2), a weight-bearing pin (3), a weight-bearing ring beam (4), a wiring device (5), a lock tongue (6), a sealing cover (7) and a linear transverse beam (8).

The socket base (1): a downward U-shaped arch is made along the perimeter of the socket body to form an inner cavity; the outer wall of the arch upwards extends to form an outer cavity; and an insertion positioning mark (101) is arranged on the bottom plane of the arch. The inner cavity has a central lug boss (102) and is provided with a countersunk through hole (103) inside; an annular rib (104) is arranged around the lug boss; in the annular rib: diametrical nailing through holes (105) are formed, radially opposite rectangular platforms (106) are protruded on the inner wall, and wiring terminal positioning holes (107) are formed in both sides of a radial line perpendicular to the central lines of the rectangular platforms;

a bulge (108) is arranged between the wiring terminal positioning holes; protruding ribs are arranged on both sides of the bulge to form chutes; the chutes break the annular rib to form a binding post slider slideway (109); the wiring terminal positioning holes extend upwards to a hollow column (110) of the outer cavity of the socket base; a threading transverse hole (111) is made on the side wall; a spacing groove (112) is made inside the adjacent side wall;

a pin guiding rib (113) is connected between the rectangular platforms; a lock tongue chute (114) is arranged on the inner side of the annular rib opposite to the binding post slider slideway; and two reversely symmetrical arc-shaped rotating positioning grooves (115) exist between the annular rib and the U-shaped arch.

The central column (2) has a hollow core (201) and can be inserted with the central lug boss of the socket base; and a cylinder (202) is arranged on the vertical surface of the outside.

The weight-bearing pin (3) comprises a pin skeleton (3*a*) and a skeleton shell (3*b*). The main body of the pin skeleton (3*a*) is a rectangular parallelepiped; the front end of the bottom surface is an inverted arc surface; a protruding transverse rib (3*a*1) is arranged on the back end of the top surface; the height of the transverse rib is lower than that of the annular rib of the socket base; a vertical groove (3*a*2) is formed in the back side surface; a groove (3*a*3) is formed in the top end which is in slide fit with the pin guiding rib of the socket base; and a guiding rib (3*a*4) is arranged on the bottom surface, and the front inverted bevel is tangent with the front arc surface of the main body.

The skeleton shell (3*b*) is a thin housing of which the cross section presents an inverted U shape and both side walls are stretched backwards and pulled up to form two vertical tails (3*b*1) of the skeleton shell; and the protruding transverse rib on the back end of the pin skeleton is covered.

The pin skeleton is inserted into the skeleton shell to form the weight-bearing pin.

The weight-bearing ring beam (4) comprises a C-shaped weight-bearing beam (4*a*), a weight-bearing beam hood (4*b*) and a weight-bearing lintel (4*c*). Radially opposite pin chutes (4*a*1) are arranged on the C-shaped weight-bearing beam (4*a*); bulges (4*a*2) are arranged on tops of both sides of the chutes; guiding grooves (4*a*3) are made on the bottom; the pin chutes are in slide fit with the weight-bearing pin; the bulges can be inserted into the annular rib from both sides of the rectangular platforms of the socket base; and the C-shaped weight-bearing beam has a lock tongue chute (4*a*4) and a nailing through hole (4*a*5) which respectively correspond to the lock tongue chute and the nailing through hole in the socket base.

An arc-shaped blind groove (4*b*1) is formed in the circumferential direction on the weight-bearing hood (4*b*) in a position opposite to the fracture of the C-shaped weight-bearing beam; a guiding partition plate (4*b*2) is arranged in the middle and a threading breach (4*b*3) is made in the inner side wall; two binding post holes (4*b*4) with sleeves are formed in the bottom of the arc-shaped blind groove and correspond to the wiring terminal positioning holes of the socket base;

an axial sealing cover positioning rib (4*b*5) is arranged on the inner wall of the weight-bearing beam hood; an open pin chute, a guiding groove and a lock tongue chute corresponding to the C-shaped weight-bearing beam are arranged on the side wall and a circular hole is formed in the bottom corresponding to the nailing through hole of the C-shaped weight-bearing beam; and all of them are exposed.

The weight-bearing lintel (4*c*) has a shape of square bracket; the inner-side distance of straight walls (4*c*1) on both sides corresponds to the width of the pin chute and can be abutted on the bulges on both sides; and the outer vertical surface (4*c*2) is inward. The C-shaped weight-bearing beam is inserted into the weight-bearing beam hood and the weight-bearing lintel is rested against the bulges to form the weight-bearing ring beam.

The wiring device (5) comprises a binding post (5*a*), a binding post top plate (5*b*), a soft conducting wire (5*c*), a wiring terminal (5*d*) in dual rectangular shape, a wire pressing spring (5*e*), a wiring clamping plate (5*f*), a wiring button (5*g*), a binding post bracket (5*h*) and a binding post slider (5*i*).

The binding post (5*a*) is a cylinder and is in slide fit with the binding post holes of the weight-bearing ring beam.

The binding post top plate (5*b*) is a circular sheet of which the external diameter is larger than that of the binding post, and is fixedly connected with the binding post. The wiring terminal (5*d*) in dual rectangular shape is bent into a dual rectangular shape by sheets; a slot (5*d*1) is formed in the top end, and is in conductive connection with the binding post top plate through the soft conducting wire (5*c*); and the wire pressing spring (5*e*) is placed in the wiring terminal in dual rectangular shape.

The main body of the wiring clamping plate (5*f*) is a square sheet, and has a central hole (5*f*1) and bulges (5*f*2) on the top and the bottom; the lower bulge can be put into the wire pressing spring; and the wiring clamping plate can move in the slot in the top end of the wiring terminal in dual rectangular shape.

The wiring button (5*g*) can slide in the hollow column of the outer cavity of the socket base, and the bottom thereof has an opening which can be embedded into the upper bulge of the wiring clamping plate.

The main body of the binding post bracket (5*h*) is an arc-shaped solid structure; two protruding ribs on the bottom surface form a chute (5*h*1); slots (5*h*2) are formed in both sides; a right-angled trapezoid lug boss (5*h*3) is arranged on the top surface;

the bracket can slide in the arc-shaped blind groove of the weight-bearing ring beam, and the slots in both sides can press against the binding post top plate.

The main body of the binding post slider (5*i*) is a rectangular parallelepiped; a trapezoid bulge (5*i*1) is arranged on the front part of the bottom surface; a positioning groove (5*i*2) is formed in the top surface; a cylinder (5*i*3) is arranged on the back side surface; the binding post slider can slide in the binding post slider slideway of the socket base and is matched and positioned through the positioning groove on the top surface and the bulge in the slideway.

The lock tongue (6): the main body is a square plate; the front protruding portion is a lock front tongue (601); the bottom is an inverted arc surface; a spring positioning bulge (602) is arranged on the back end; the lock tongue can slide within the lock tongue chute of the socket base and the lock tongue chute of the weight-bearing ring beam.

The sealing cover (7) is circular and can be inserted into the weight-bearing ring beam of the socket; and a threaded hole (701) is formed in the central lug boss.

The linear transverse beam (8) has an earthing screw (801) in the center and long through grooves (802) are formed in both sides of the screw; by using the central line as a symmetric axis, reversely symmetrical long belts are added on both sides of the linear transverse beam; the long belts are made to inwards bend rectangularly twice to form U-shaped side ears and threaded holes (803) are respectively drilled thereon; and the positions of the threaded holes (803) correspond to the nailing through holes of the socket base.

A weight-bearing plug for a pendent lamp comprises a junction box (10), a weight-bearing bottom plate (11), a plug weight-bearing ring beam (12) and an unlocking component (13).

The junction box (10) comprises a box cover (10*a*), a box body (10*b*), a balance vertical column (10*c*), a wiring vertical column (10*d*) and a wiring terminal (10*e*).

The box cover (10*a*) of the junction box has the shape of a circular ring; a positioning rib (10*a*1) is arranged on the box cover; a diametrical box cover assembling hole (10*a*2) is formed in the outer side of the positioning rib; a balance vertical column guiding sleeve and a hole (10*a*3), and a wiring vertical column guiding sleeve and a hole (10*a*4) are respectively formed in both sides of the central line of the assembling hole; symmetrical wiring terminal positioning ribs (10*a*5) are arranged on the circumference in the box cover, and a semicircular threading groove is also formed; the central lines of the positioning ribs are perpendicular to the central line of the assembling hole; wiring screw holes (10*a*6) are formed in the outer sides of the positioning ribs; and a nailing hole (10*a*7) is formed in the box cover.

The box body (10*b*) of the junction box is an open housing; a central hole (10*b*1) is formed in the bottom; a diametrical lug boss (10*b*2) of a threaded hole or through hole is arranged inside; a balance vertical column depression (10*b*3) and a wiring vertical column depression (10*b*4) are respectively arranged on both sides of the central line of the diametrical lug boss and respectively correspond to the assembling hole of the box cover, the balance vertical column guiding sleeve and the wiring vertical column guiding sleeve; symmetrical wiring terminal fixing ribs (10*b*5) are arranged on the radial line perpendicular to the central line of the diametrical lug boss, and a semicircular threading groove is also formed, corresponding to the wiring terminal positioning ribs of the box cover and the semicircular threading groove thereof; and the outer side of the outer wall of the box body is subject to axial tension to form annular steps (10*b*6).

The balance vertical column (10*c*) is formed by superposing different-diameter cylinders and is in movable fit with the balance vertical column guiding sleeve of the box cover and the hole.

The wiring vertical column (10*d*) is formed by superposing different-diameter cylinders and is in movable fit with the wiring vertical column guiding sleeve of the box cover and the hole.

The wiring terminal (10*e*) is a rectangular parallelepiped; a threading hole (10*e*1) is formed in the front side surface; a wiring screw (10*e*2) is arranged on the top surface and its position corresponds to the wiring screw hole on the box cover; and the wiring terminal and the wiring vertical column are connected through the soft conducting wire (10*f*).

The weight-bearing bottom plate (11) is in cross shape and has a flange central hole (1101); the external diameter of the flange and the internal diameter of the central hole in the bottom of the box body are in insertion fit; the outer end is made to bend in Z shape, and a threaded hole (1102) is formed; and the weight-bearing bottom plate can be placed in the junction box.

The plug weight-bearing ring beam (12) comprises a ring beam skeleton (12*a*) and a ring beam skeleton hood (12*b*).

The main body of the ring beam skeleton (12*a*) is an annular body; on the annular body: radially-symmetrical bulges are arranged; a pair of opposite pin clamping grooves (12*a*1) with openings on the bottom are drawn from the inner side and are matched with the weight-bearing pin of the socket; the side walls of the pin clamping grooves are respectively stretched outwards to form reversely symmetrical ramps (12*a*2); protruding ribs are arranged on the tops of the bulges and threaded holes (12*a*3) are drilled; on the annular body: an arc-shaped bulge is arranged on the radial line perpendicular to the central lines of the pin clamping grooves; the inner part of the bottom is sucked to be a cavity (12*a*4); a circular hole (12*a*5) is formed in the outer side wall; a lock tongue clamping groove (12*a*6) with an opening on the bottom is formed in the inner wall and is in clearance fit with a lock tongue in the socket; on the annular body: nailing through holes (12*a*7) are drilled along the circumferential direction and correspond to the nailing hole of the junction box cover; on the annular body: an arc positioning lug boss (12*a*8) is arranged on the bottom and is in insertion fit with the annular steps of the box body.

Inverted inner and outer arcs are formed along the circumferential direction on the top of the ring beam skeleton hood (12*b*), and an insertion positioning groove (12*b*1) is formed in the outer arc: a circular hole (12*b*2) is drilled in the outer wall which is same-radial opposite to the insertion positioning groove, and corresponds to the circular hole in the outer side wall of the arc-shaped bulge of the ring beam skeleton; the inner wall is open so that the lock tongue clamping groove of the ring beam skeleton is exposed; a diametrical countersunk through hole (12*b*3) is made in the radial top perpendicular to the insertion positioning groove and corresponds to the threaded hole of the protruding ribs of the ring beam skeleton; the inner wall is open so that the pin clamping groove of the ring beam skeleton and the ramps are exposed; and a diametrical rotating positioning frustum (12*b*4) is arranged on the same-radial top of the insertion positioning groove.

After the ring beam skeleton is pressed into the ring beam skeleton hood, the plug weight-bearing ring beam is formed; the external diameter thereof is less than the internal diameter of the U-shaped arch of the socket base; and the internal diameter thereof is greater than the external diameter of the weight-bearing ring beam of the socket.

The unlocking component (13) comprises a lock core sleeve (13*a*) and a lock core (13*b*).

The lock core sleeve (13*a*) is a thin wall hollow cylinder; one end is necked to form a contraction port (13*a*1); and the lock core sleeve and the circular hole in the outer side wall of the arc-shaped bulge of the ring beam skeleton are in press fit.

The lock core (13*b*) is a variable diameter cylinder; the front-segment cylinder (13*b*1) is connected with a flange disc (13*b*2) and then connected with a central-segment cylinder (13*b*3); the diameter of the end-segment cylinder (13*b*4) is less than the diameter of the central-segment cylinder; and movable fit is made between the flange disc of the lock core and the lock core sleeve, between the front-segment cylinder and the contraction port and between the end-segment cylinder and the lock tongue clamping groove in the ring beam skeleton.

The lock core is inserted into the lock core sleeve to form the unlocking component. The improved unlocking component (14) is a lock handle; the main body is a square solid structure (1401); a cylinder (1402) is stretched from the bottom surface; the top surface and the left side are vacuumized to form an inner cavity; protruding ribs (1403) are arranged on the right side surface and have inverted bevels on the upper end; and the square solid structure and the protruding ribs can respectively slide in the cavity of the arc-shaped bulge of the ring beam skeleton and the lock tongue clamping groove.

The present invention has the beneficial effect: because the socket can be installed and wired to the ceiling in advance and can be permanently used once installed, as long as the lamp is assembled and wired to the plug of the present invention, installation and disassembly of the pendent lamp are as simple as insertion and extraction of the plug.

BRIEF DESCRIPTION OF THE DRAWINGS

The specific embodiments of the present invention will be further described below in detail in conjunction with the accompanying drawings.

In the figures.

| | | | |
|---|---|---|---|
| 1-socket base | 2-central column | 3-weight-bearing pin | 3a-pin skeleton |
| 3b-skeleton shell | 4-weight-bearing ring beam | 4a-C-shaped weight-bearing beam | 4b-weight-bearing beam hood |
| 4c-weight-bearing lintel | 5-wiring device | 5a-binding post | 5b-binding post top plate |
| 5c-soft conducting wire | 5d-wiring terminal in dual rectangular shape | 5e-wire pressing spring | 5f-wiring clamping plate |
| 5g-wiring button | 5h-binding post bracket | 5i-binding post slider | 6-lock tongue |
| 7-sealing cover | 8-linear transverse beam | 9-socket installing bolt | |
| 10-junction box | 10a-box cover of junction box | 10b-box body of junction box | 10c-balance vertical column |
| 10d-wiring vertical column | 10e-wiring terminal | 10f-soft conducting wire | 11-weight-bearing bottom plate |
| 12-plug weight-bearing ring beam | 12a-ring beam skeleton | 12b-ring beam skeleton hood | 13-unlocking component |
| 13a-lock core sleeve | 13b-lock core | 14-lock handle | 15-binding post resetting spring |

-continued

| | | | |
|---|---|---|---|
| 16-compression spring | 17-sealing cover screw | 18-balance pressure spring | 19-box body screw |
| 20-lock core resetting spring | 21-plug assembling screw | 22-ring beam hood screw | 23-plug weight-bearing screw |

DETAILED DESCRIPTION OF THE EMBODIMENTS

Embodiments of Socket Assembly

Figure 9:
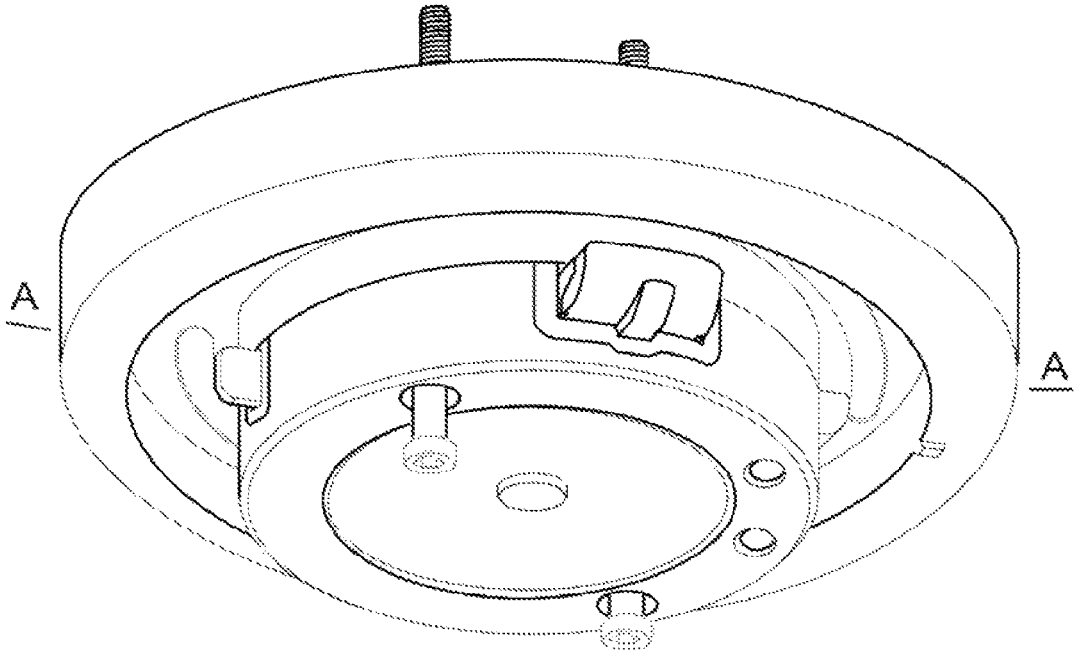
FIG. 9 shows a stereographic view and a sectional view of socket assembly.
Figure 9:
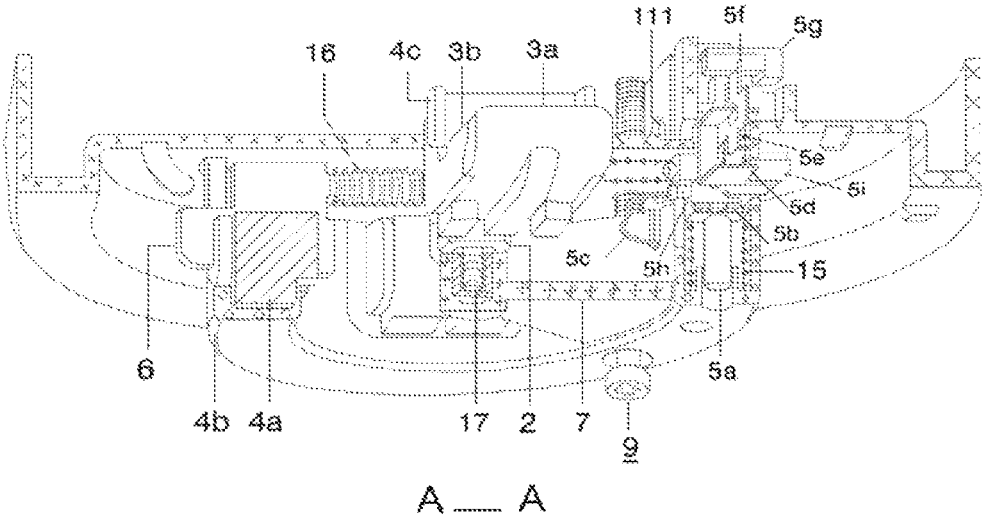

FIG. 9 shows a stereographic view and a sectional view of socket assembly.

Figure 1:
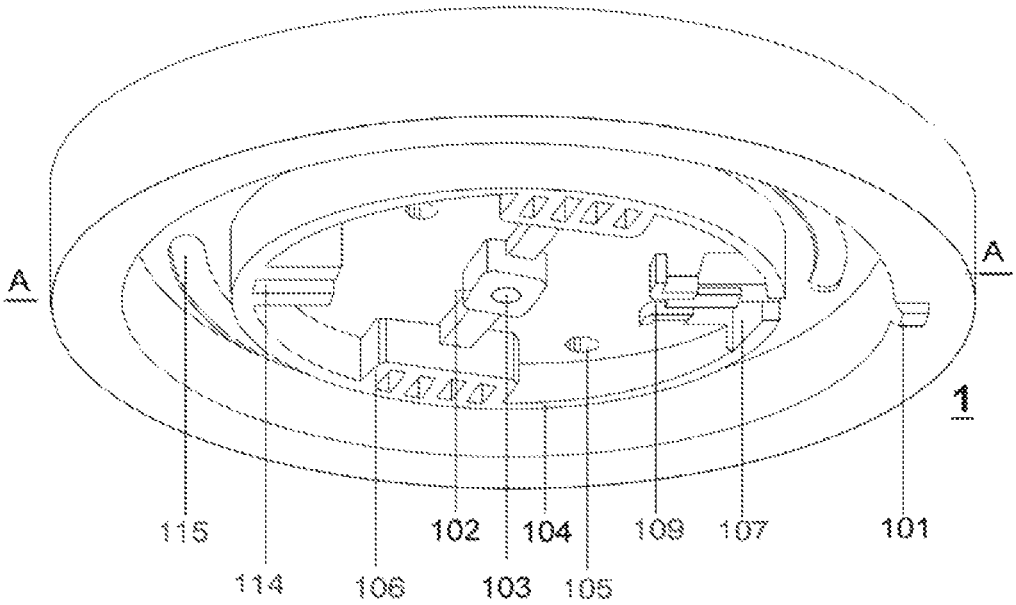
FIG. 1 shows a stereographic view and a sectional view of a socket base.
Figure 1:
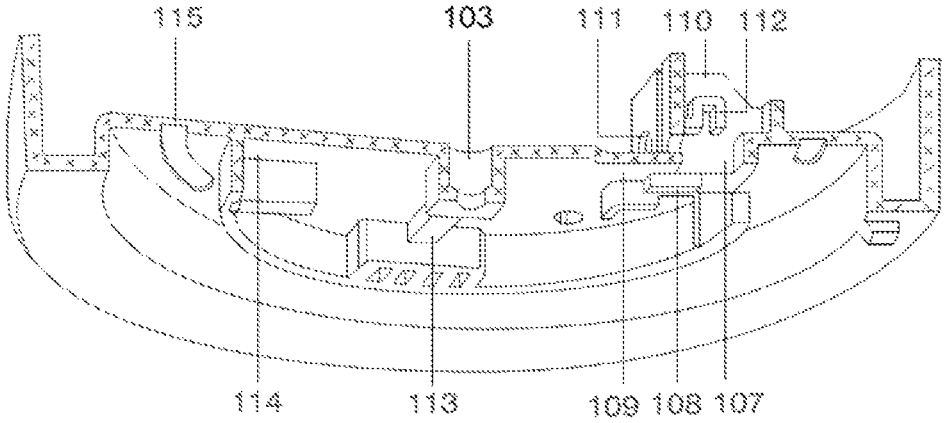

FIG. 1 shows a stereographic view and a sectional view of a socket base. The socket base 1 is a basic part of the present invention.

Figure 2:
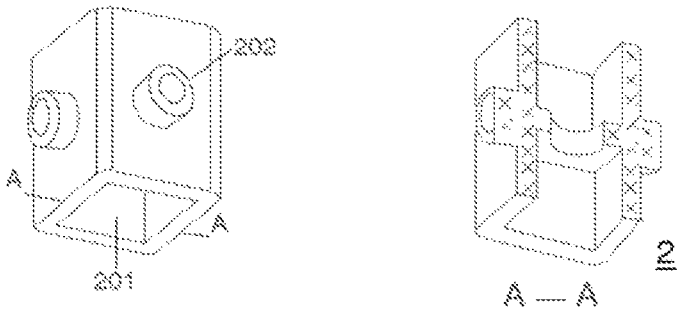
FIG. 2 shows a stereographic view and a sectional view of a central column.

FIG. 2 shows a stereographic view and a sectional view of a central column. The central lug boss 102 of the socket base is inserted into the hollow core 201 of the central column; the cylinder 202 on the external vertical surface is respectively opposite to the rectangular platforms 106 of the socket base, the slideway 109 and the chutes 114 for finishing the installation of the central column 2.

Figure 3:
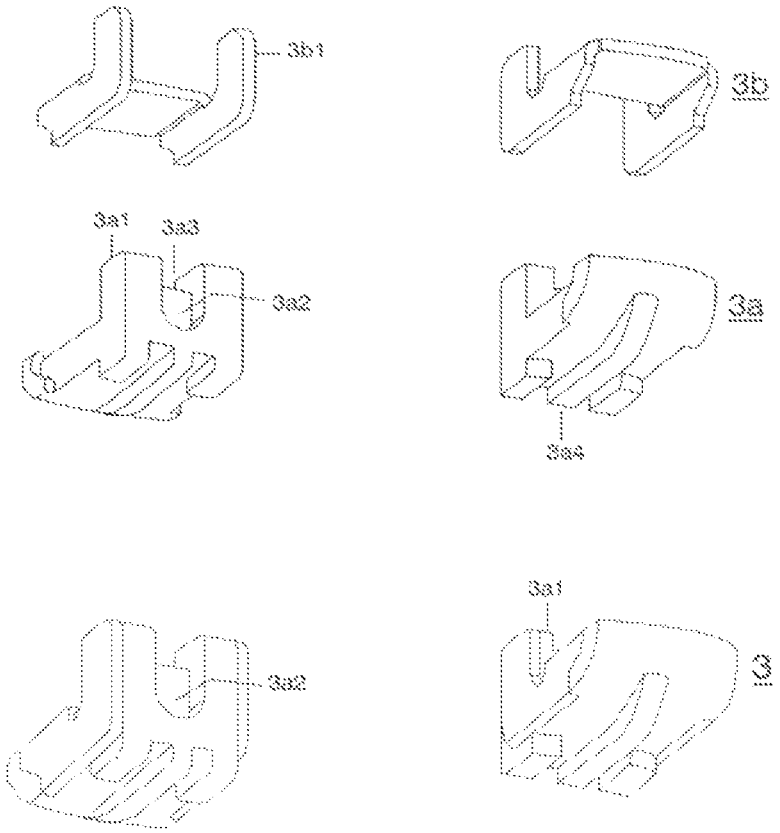
FIG. 3 shows stereographic views of a weight-bearing pin.

FIG. 3 shows stereographic views of a weight-bearing pin. The pin skeleton 3*a* is pressed into the skeleton shell 3*b* to form the weight-bearing pin 3.

Figure 4:
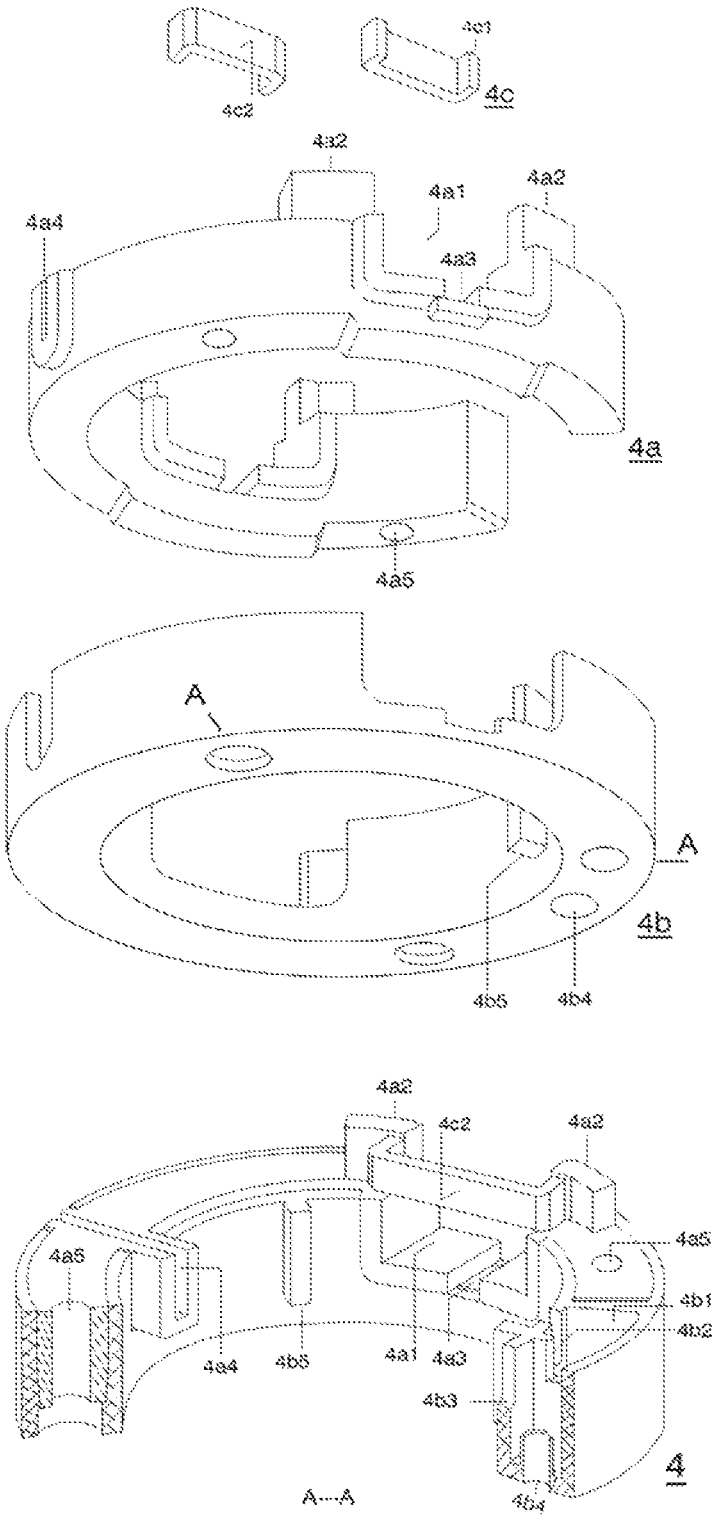
FIG. 4 shows stereographic views and a sectional view of a weight-bearing ring beam.

FIG. 4 shows stereographic views and a sectional view of a weight-bearing ring beam. The C-shaped weight-bearing beam 4*a* and the weight-bearing lintel 4*c* are assembled:

The weight-bearing lintel 4*c* is buckled into the rectangular platform 106 of the socket base and the external vertical surface 4*c*2 is inward; after placed on both sides of the rectangular platform 106, the bulges 4*a*2 of the C-shaped weight-bearing beam are inserted into the annular rib 104; straight walls 4*c*1 on both sides of the weight-bearing lintel are butted against the bulges 4*a*2; the assembled weight-bearing pin 3 is inserted into the pin chute 4*a*1 of the C-shaped weight-bearing beam: the transverse rib groove 3*a*3 of the weight-bearing pin is buckled with the pin guiding rib 113 of the socket base; the bottom surface guiding rib 3*a*4 slides into the bottom guiding groove 4*a*3 of the pin chute of the C-shaped weight-bearing beam; and the vertical tail 3*b*1 is abutted on the external vertical surface 4*c*2 of the weight-bearing lintel.

Figure 5:
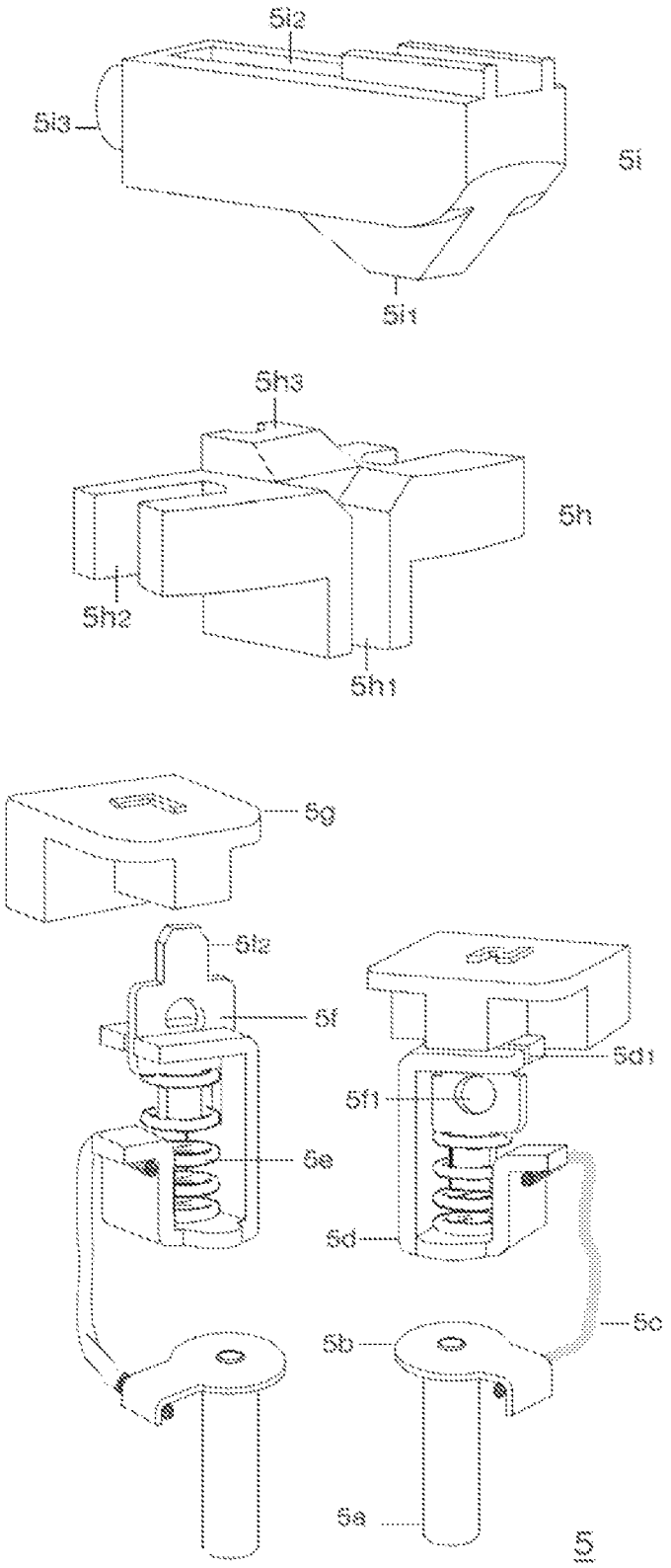
FIG. 5 shows stereographic views of a wiring device.

FIG. 5 shows stereographic views of a wiring device. The wiring device is assembled:

The wiring button 5*g* is put into the hollow column 110 of the outer cavity of the socket base;

the wiring clamping plate 5*f* penetrates through the wiring terminal positioning hole 107 of the socket base and is inserted into the spacing groove 112 in the side wall in the hollow column 110; at this moment, the central hole 5*f*1 of the wiring clamping plate is opposite to the threading transverse hole 111 of the socket base; the upper bulge 5*f*2 is inserted into the opening on the bottom of the wiring button;

the front trapezoid bulge 5*i*1 on the bottom surface of the binding post slider 5*i* is outward, and is put into the binding post slider slideway 109 in the socket base; the bulge 108 in the slideway is put into the top surface positioning groove 5*i*2 of the binding post slider; the cylinder 5*i*3 on the back side surface is opposite to the cylinder 202 on the external vertical surface of the central column 2;

the binding post (5*a*) is fixedly connected to the binding post top plate 5*b* and is in conductive connection with the wiring terminal 5*d* in dual rectangular shape through the soft conducting wire 5*c;* the binding post resetting spring 15 is put outside the sleeve of the binding post hole 4*b*4 of the weight-bearing beam hood 4*b*, and then the binding post 5*a* is put into the binding post hole 4*b*4;

the binding post bracket 5*h* is put into the arc-shaped blind groove 4*b*1 of the weight-bearing beam hood; the guiding partition plate 4*b*2 slides into the chute 5*h*1 thereof; the slots 5*h*2 on both sides press against the binding post top plate 5*b*; the soft conducting wire 5*c* slides into the threading breach 4*b*3 on the inner side wall; the right-angled trapezoid lug boss 5*h*3 on the top surface is upward;

the wiring terminal 5*d* in dual rectangular shape is inserted into the wiring terminal positioning hole 107 of the socket base; after the wiring clamping plate enters the top slot 5*d*1, the lower bulge of the wiring clamping plate enters and the main body touches the wire pressing spring 5*e;* and the weight-bearing beam hood 4*b* is sheathed into the C-shaped weight-bearing beam 4*a* to finish the assembly of the wiring device 5 and the weight-bearing ring beam 4.

Figure 6:
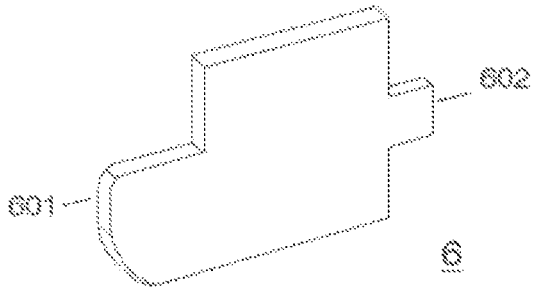
FIG. 6 is a stereographic view of a lock tongue.

FIG. 6 is a stereographic view of a lock tongue. The lock tongue 6 is inserted into the lock tongue chute 4*a*4 of the weight-bearing ring beam and the lock tongue chute 114 of the socket base; the lock front tongue 601 is outward; the spring positioning bulge 602 is inward; the lock tongue main body is clamped by the annular rib 104 of the socket base;

and the compression springs 16 are respectively pressed between the cylinder 202 on the external vertical surface of the central column 2 and: the bulge 602 of the lock tongue 6, the vertical groove 3*a*2 of the back side surface of the weight-bearing pin 3 and the cylinder 5*i*3 on the back side surface of the binding post slider 5*i*.

Figure 7:
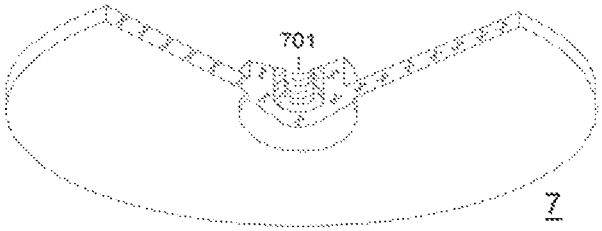
FIG. 7 is a stereographic sectional view of a sealing cover.

FIG. 7 is a stereographic sectional view of a sealing cover. The threaded hole 701 of the sealing cover 7 is inwards inserted into the weight-bearing ring beam 4 and abutted against the sealing cover positioning rib 4*b*5 therein; and the sealing cover screw 17 penetrates through the countersunk through hole 103 of the socket base and the hollow core 201 of the central column, and is screwed in the threaded hole of the sealing cover. So far, the socket assembly of the present invention is finished.

Embodiment I of Plug Assembly

Figure 15:
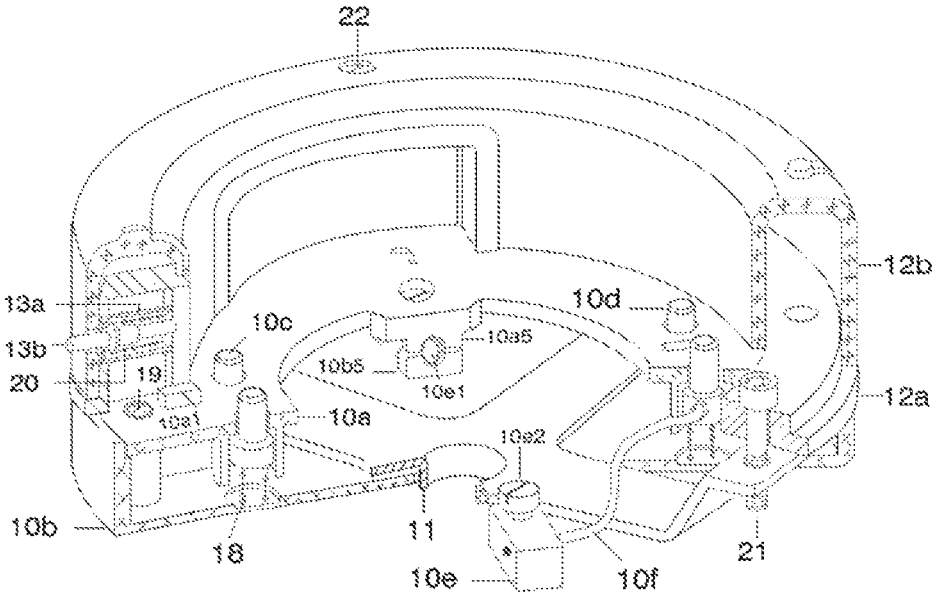
FIG. 15 is a stereographic sectional view of plug assembly Example I

FIG. 15 is a stereographic sectional view of plug assembly Example I

Figure 10:
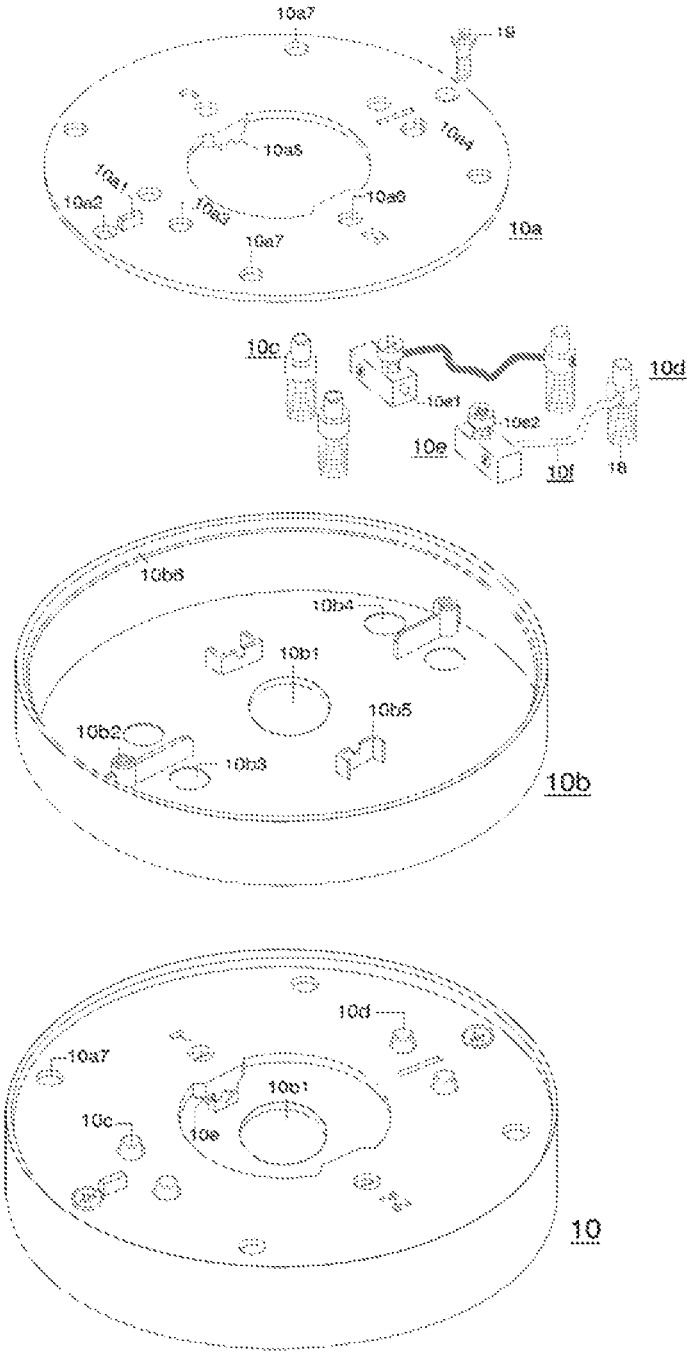
FIG. 10 shows stereographic views of a junction box.

FIG. 10 shows stereographic views of a junction box. The junction box is assembled:

The balance vertical column 10*c* is put into the balance vertical column guiding sleeve of the box cover 10*a* of the junction box and the hole 10*a*3; the wiring vertical column 10*d* and the wiring terminal 10*e* connected with the soft conducting wire 10*f* are respectively put into the wiring vertical column guiding sleeve, the hole 10*a*4 and the wiring terminal positioning rib 10*a*5; and the balance pressure spring 18 is respectively put into the sleeves 10*a*3 and 10*a*4.

Figure 11:
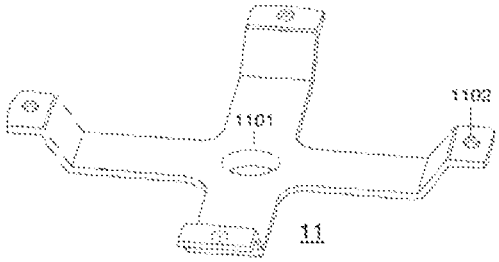
FIG. 11 is a stereographic view of a weight-bearing bottom plate.

FIG. 11 is a stereographic view of a weight-bearing bottom plate. The weight-bearing bottom plate 11 is put into the box body 10*b* of the junction box; the flange of the central circular hole 1101 is inserted into the central hole 10*b*1 of the box body; the box cover and the box body are pressed together; the threaded hole 1102 of the weight-bearing bottom plate coincides with the nailing hole 10*a*7 of the box cover; the balance pressure spring is respectively positioned in the box body depressions 10*b*3 and 10*b*4; the wiring terminal positioning rib 10*a*5 of the box cover and the wiring terminal fixing rib (10*b*5) of the box body are combined two semicircular threading grooves are combined into a circular hole; the wiring terminal 10*e* is pressed, and the threading hole 10*e*1 is exposed; and the box body screw 19 penetrates through the box cover assembling hole 10*a*2 and is screwed in the threaded hole 10*b*2 of the lug boss of the box body to finish the assembly of the junction box.

Figure 12:
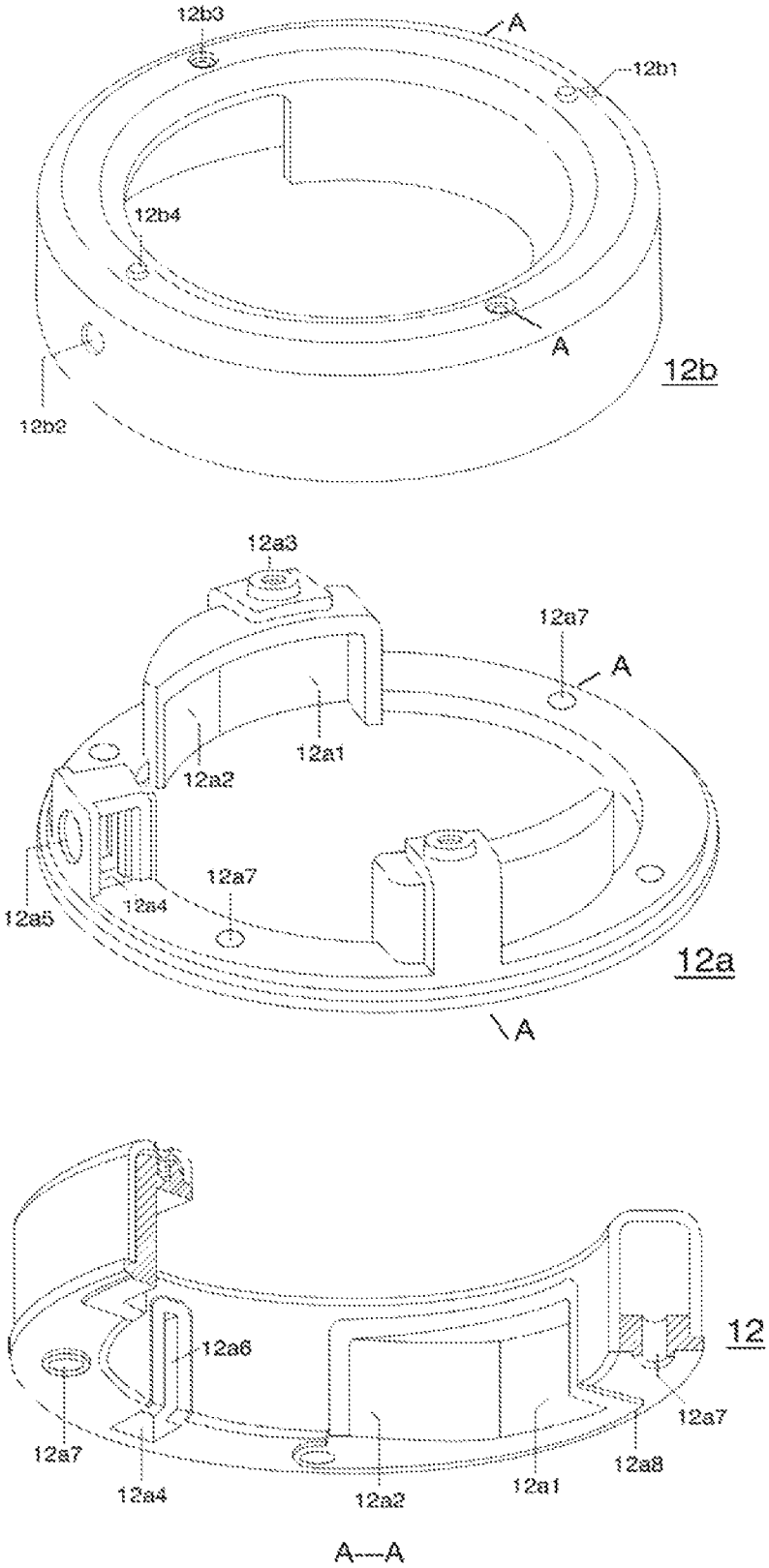
FIG. 12 shows stereographic views and a sectional view of a plug weight-bearing ring beam.

FIG. 12 shows stereographic views and a sectional view of a plug weight-bearing ring beam.

Figure 13:
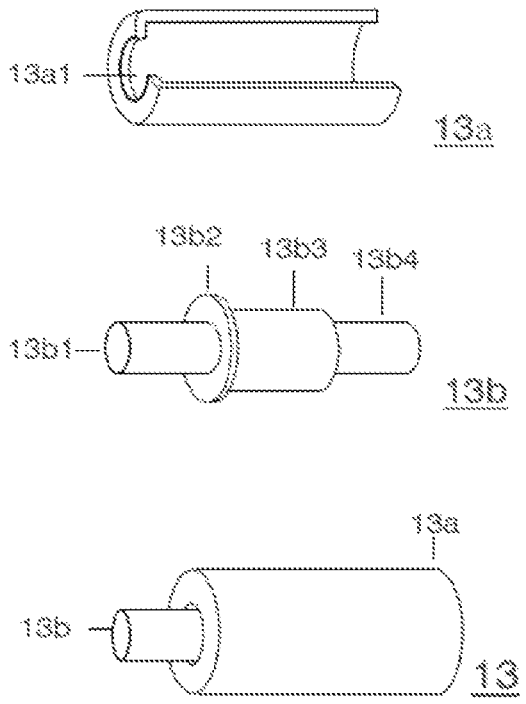
FIG. 13 shows stereographic views of an unlocking component.

FIG. 13 shows stereographic views of an unlocking component. The unlocking component and the ring beam skeleton are assembled:

The lock core 13*b* is put into the lock core sleeve 13*a*, and is pressed into the lock core resetting spring 20; then, the lock core 13*b* and the lock core sleeve 13*a* are pressed together into the circular hole 12*a*5 in the outer side wall of the arc-shaped bulge of the ring beam skeleton 12*a;* the bottom opening of the lock tongue clamping groove 12*a*6 of the ring beam skeleton is aligned with the positioning rib 10*a*1 on the box cover of the junction box; the nailing through hole 12*a*7 is aligned with the nailing hole 10*a*7 of the box cover; the arc positioning lug boss 12*a*8 of the ring beam skeleton is pressed into the annular steps 10*b*6 of the box body; the plug assembling screw 21 respectively penetrates through the ring beam skeleton, the nailing through hole 12*a*7 and the nailing hole 10*a*7 of the box cover and is screwed to the threaded hole 1102 of the weight-bearing bottom plate 11; the front-segment cylinder 13*b*1 of the lock core is pressed into the ring beam skeleton 12*a*, and then the ring beam skeleton hood 12*b* is buckled; under the action of the lock core resetting spring 20 on the lock core 13*b*, the front-segment cylinder 13*b*1 of the lock core is exposed from the circular hole 12*b*2 in the outer wall of the ring beam skeleton hood; and the ring beam hood screw 22 penetrates through the countersunk through hole 12*b*3 of the ring beam skeleton hood and is screwed in the threaded hole 12*a*3 of the protruding rib of the ring beam skeleton. So far, the plug assembly is finished.

Embodiment II of Plug Assembly

Figure 16:
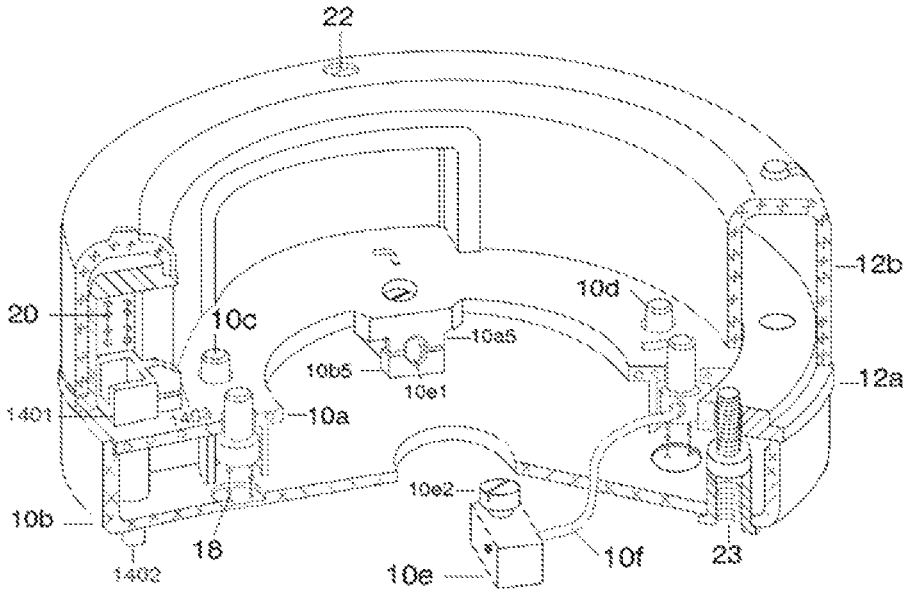
FIG. 16 is a stereographic sectional view of plug assembly Example II

FIG. 16 is a stereographic sectional view of plug assembly Example II

The embodiment is almost the same as Embodiment I, and the difference is only that:

1. The weight-bearing bottom plate 11 is replaced by the plug weight-bearing screw 23, and the junction box 10 and the ring beam skeleton 12*a* are assembled into a whole.
2. The lock core sleeve 13*a* and the lock core 13*b* are replaced by the lock handle 14 of the improved unlocking component.

Figure 14:
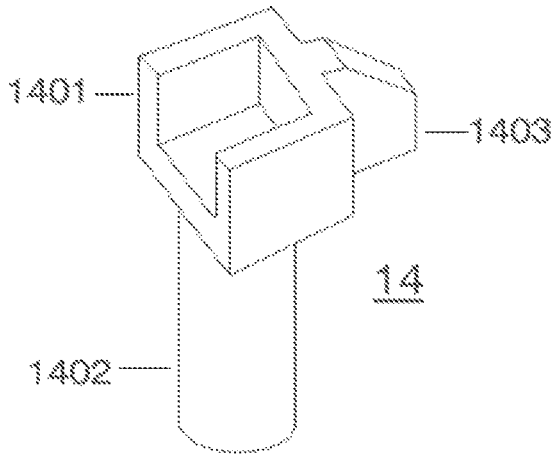
FIG. 14 is a stereographic view of an improved unlocking component.

FIG. 14 is a stereographic view of an improved unlocking component. The cylinder 1402 on the bottom of the lock handle 14 penetrates through the box cover assembling hole 10*a*2 of the junction box and the through hole 10*b*2 of the lug boss of the box body and is exposed from the junction box; the main body 1401 and the side protruding rib 1403 are respectively put into the cavity 12*a*4 of the arc-shaped bulge of the ring beam skeleton and the lock tongue clamping groove 12*a*6; and the lock core resetting spring 20 is pressed into the inner cavity of the main body.

Figure 17:
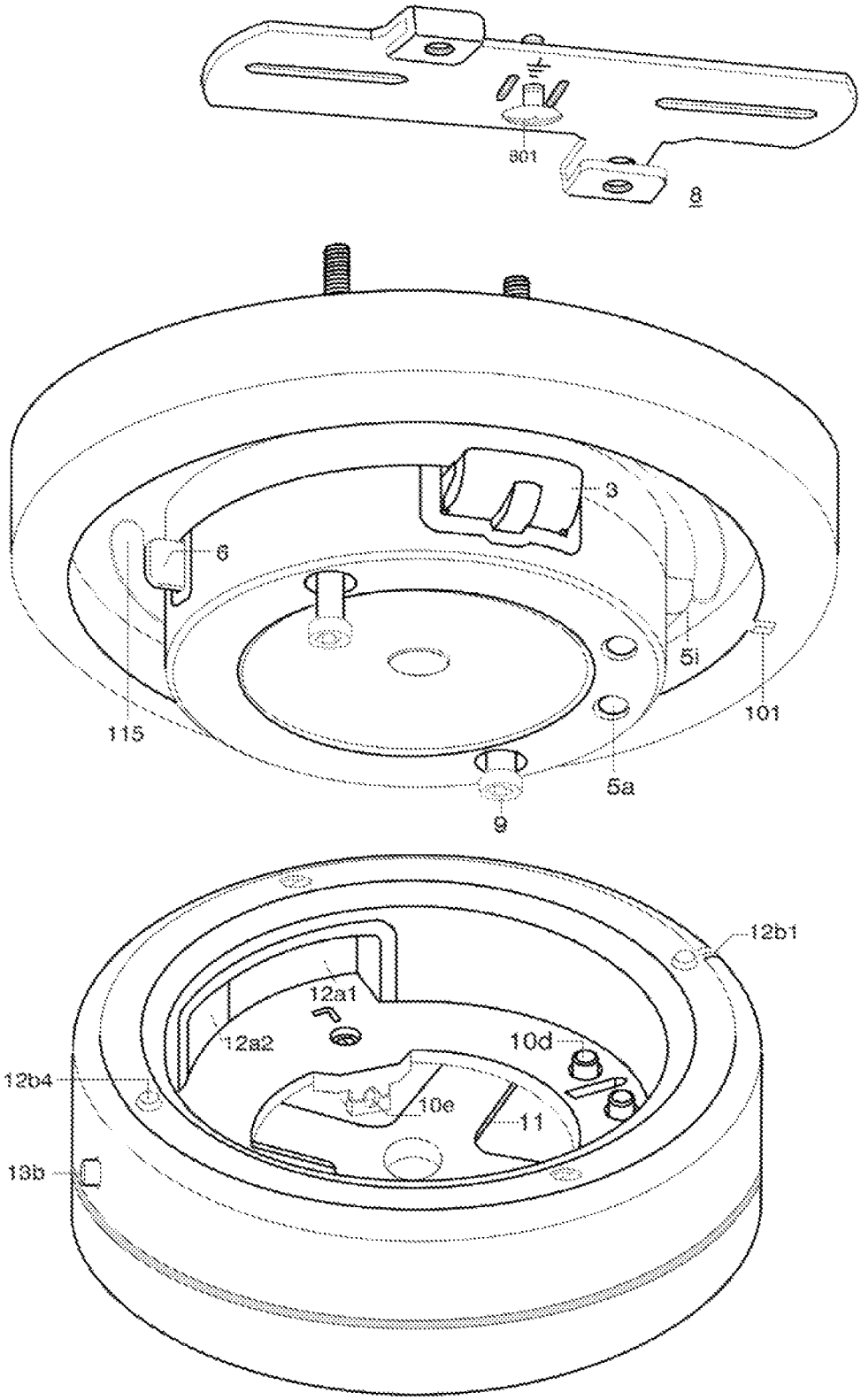
FIG. 17 shows stereographic general views of a weight-bearing socket and plug.

Installation and use of the Socket and the Plug:

FIG. 17 shows stereographic general views of a weight-bearing socket and plug.

Figure 8:
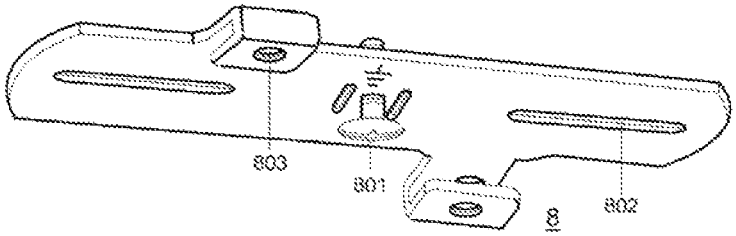
FIG. 8 is a stereographic view of a linear transverse beam.

FIG. 8 is a stereographic view of a linear transverse beam.

Installation and wiring of the socket: The earthing screw 801 of the linear transverse beam 8 is connected with an earth wire; long through grooves 802 are installed on the ceiling; the wiring button 5*g* is pressed; the central hole 5*f*1 of the wiring clamping plate 5*f* and the threading transverse hole 111 of the socket base are aligned; a power line is inserted; after the wiring button is released, the wire pressing spring 5*e* presses the wiring clamping plate and well clamps the power line; and the installing bolt 9 penetrates through the nailing through hole 4*a*5 of the weight-bearing ring beam 4 and the nailing through hole 105 of the socket base 1 and is screwed in the threaded hole 803 of the linear transverse beam to finish the installation of the socket.

Wiring and installation of the plug: The conducting wire of the pendent lamp penetrates through the central hole of the junction hole, and is inserted into the threading hole 10*e*1 of the wiring terminal; the wiring screw 10*e*2 is screwed; and the lamp is connected with the weight-bearing bottom plate 11 or the plug weight-bearing screw 23.

Embodiment I of Installation and Disassembly of the Lamp

Installation of the lamp: The insertion positioning groove 12*b*1 of the plug is aligned with the insertion positioning mark 101 of the socket base and pushed upwards; the plug weight-bearing ring beam touches the circumferential arc surface: the front bevel of the bottom surface guiding rib of the weight-bearing pin 3, the arc surface of the lock front tongue of the lock tongue 6, and the bevel of the front trapezoid bulge on the bottom surface of the binding post slider 5*i* are respectively contracted into the socket; after the plug is completely inserted into the socket, the compression spring 16 respectively pushes the lock tongue 6 to enter the lock tongue clamping groove 12*a*6 of the plug, and pushes the weight-bearing pin 3 to enter the pin clamping groove 12*a*1 of the plug and to string the top thereof for achieving the purposes of locking and weight bearing;

the bevel of the trapezoid bulge 5*i*1 of the binding post slider slides along the bevel of the right-angled trapezoid lug boss 5*h*3 on the binding post bracket for pushing the binding post bracket 5*h* to move downwards in the arc-shaped blind groove 4*b*1 of the weight-bearing ring beam 4; the binding post 5*a* is pushed out of the binding post hole 4*b*4; and the wiring vertical column 10*d* in the junction box comes into close contact with the binding post 5*a* of the socket under the action of the balance pressure spring 18 for achieving the purpose of electrical connection.

Disassembly of the lamp: The lock core 13*b* is pressed, which moves inwards along the lock core sleeve 13*a* for pushing the lock tongue 6 to move into the socket; the plug is rotated; the weight-bearing pin 3 slides along the ramp 12*a*2 of the plug weight-bearing ring beam; when the rotating positioning frustum 12*b*4 moves to the destination of the arc-shaped rotating positioning groove 115 of the socket base, the weight-bearing pin 3 is completely contracted into the socket so the lamp can be disassembled;

and after the compression spring 16 pushes the binding post slider out of the socket, the binding post 5*a* is brought by the binding post resetting spring 15 back into the binding post hole 4*b*4.

Embodiment II of Installation and Disassembly of the Lamp

Installation of the lamp: It is consistent with the Embodiment I of installation and disassembly of the lamp.

Disassembly of the lamp: The bottom surface cylinder 1402 of the lock handle 14 is pushed upwards; the main body 1401 and the side protruding rib 1463 respectively move upwards along the cavity 12*a*4 of the arc-shaped bulge of the ring beam skeleton and the lock tongue clamping groove 12*a*6; the upper bevel of the side protruding rib comes into contact with the arc surface of the lock front tongue; the lock tongue 6 is pushed into the socket; and the lamp is disassembled in the manner of Embodiment I.

I claim:

1. A weight-bearing socket for a pendent lamp, comprising a socket base (1), a central column (2), a weight-bearing pin (3), a weight-bearing ring beam (4), a wiring device (5), a lock tongue (6), a sealing cover (7) and a linear transverse beam (8), characterized in that:

a downward U-shaped arch is made on the perimeter of the socket base (1) to form an inner cavity, wherein the arch comprises an outer wall and an inner wall; the outer wall of the arch upwards extends to form an outer cavity; an insertion positioning mark (101) is arranged on the bottom plane of the arch;

the inner cavity has a central lug boss (102) and is provided with a countersunk through hole (103) inside; an annular rib (104) is arranged around the lug boss; in the annular rib; diametrical nailing through holes (105) are formed, radially opposite rectangular platforms (106) are arranged on the inner wall of the arch, wherein the rectangular platforms comprise a radial line and central lines, wherein the radial line is perpendicular to the central lines, and wiring terminal positioning holes (107) are formed in both sides of the radial line the central column (2) has a hollow core (201) and can be inserted with the central lug boss; and a cylinder (202) is arranged on the external vertical surface;

the front end of the bottom surface of the weight-bearing pin (3) is an inverted, arc surface; a protruding transverse rib (3*a*1) is arranged on the back end of the top surface; the height of the weight-bearing pin (3) is lower than that of the annular rib; and a vertical groove (3*a*2) is arranged on the back side surface;

the weight-bearing ring beam (4) has radially opposite pin chutes (4*a*1) which are in slide fit with the weight-bearing pin; bulges (4*a*2) are arranged on tops of both sides of the chutes and can be inserted into the annular rib from both sides of the rectangular platforms; a lock tongue chute (4*a*4) is radially arranged perpendicularly to the central lines of the pin chutes; the weight-bearing ring beam is circumferentially provided with binding post holes (4*b*4) and nailing through holes (4*a*5) which respectively correspond to the wiring terminal positioning holes and the nailing through holes of the socket base; an axial sealing cover positioning rib (4*b*5) is arranged on the inner wall of the weight-bearing ring beam;

the wiring device (5) contains a binding post (5*a*) and a wiring terminal (5*b*) which can be respectively put into the binding post holes of the weight-bearing ring beam and the wiring terminal positioning holes of the socket base and are made for conductive connection;

the lock tongue (6) comprises a front protruding portion, wherein the front protruding portion of the lock tongue (6) is a lock front tongue (601); the bottom is an inverted arc surface; a spring positioning bulge (602) is arranged on the back end; the lock tongue can slide within the lock tongue chute of the weight-bearing ring beam;

the sealing cover (7) can be inserted into the weight-hearing ring beam; a lug boss threaded hole (701) is formed in the center; and the linear transverse beam (8) has an earthing screw (801) and long through grooves (802); reversely symmetrical long belts are added on both sides of the linear transverse beam; the long belts are made to inwards bend rectangularly twice to form U-shaped side ears and threaded through holes (803) are drilled; and the positions of the threaded through holes (803) correspond to the nailing through holes of the socket base.

2. The socket for the pendent lamp according to claim 1, characterized in that: the bulge (108) is arranged between the wiring terminal positioning holes of the socket base (1); protruding ribs are arranged on both sides of the bulge to form chutes; after the annular rib is broken, a binding post slider slideway (109) is formed; the wiring terminal positioning holes extend upwards to a hollow column (110) of the outer cavity of the socket base; a threading transverse hole (111) is made on the side wall; a spacing groove (112) is made inside the adjacent side wall; a pin guiding rib (113) is arranged between the rectangular platforms; the lock tongue chute (114) is arranged on the inner side of the annular rib opposite to the binding post slider slideway; and two reversely symmetrical arc-shaped rotating positioning grooves (115) exist between the annular rib and the U-shaped arch.

3. The socket for the pendent lamp according to claim 1, wherein the weight-bearing pin (3) comprises a pin skeleton (3*a*) and a skeleton shell (3*b*), characterized in that:

the main body of the pin skeleton (3*a*) is a rectangular parallelepiped; the front end of the bottom surface is an inverted arc surface; a protruding transverse rib (3*a*1) is arranged on the back end of the top surface; the height of the transverse rib is lower than that of the annular rib of the socket base; a vertical groove (3*a*2) is formed in the back side surface; a groove (3*a*3) is formed in the top end which is in slide fit with the pin guiding rib of the socket base; a guiding rib (3*a*4) is arranged on the bottom surface of the pin skeleton; the front inverted bevel is tangent with the from arc surface of the main body; and the skeleton shell (3*b*) is a thin housing of which the cross section presents an inverted U shape and both side walls are stretched backwards and pulled up to form two vertical tails (3*b*1) of the skeleton shell; the protruding transverse rib on the back end of the pin skeleton is covered; and after the pin skeleton is put into the skeleton shell, the weight-bearing pin is formed.

4. The socket for the pendent lamp according to claim 1, wherein the weight-bearing ring beam (4) comprises a C-shaped weight-bearing beam (4*a*), a weight-bearing beam hood (4*b*) and a weight-bearing lintel (4*c*), characterized in that:

radially opposite pin chutes (4*a*1) are arranged on the C-shaped weight-bearing beam (4*a*); bulges (4*a*2) are arranged on tops of both sides of the pin chutes; guiding grooves (4*a*3) are made on the bottom; the pin chutes are in slide fit with the weight-bearing pin; the bulges can be inserted into the annular rib on both sides of the rectangular platform of the socket base; and the C-shaped weight-bearing beam has a lock tongue chute (4*a*4) and a nailing through hole (4*a*5) which respectively correspond to the lock tongue chute and the nailing through hole in the socket base;

an arc-shaped blind groove (4*b*1) is formed in the circumferential direction of the weight-bearing hood (4*b*), a guiding partition plate (4*b*2) is arranged in the middle and a threading breach (4*b*3) is made in the inner side wall; two binding post holes (4*b*4) with sleeves are formed in the bottom of the arc-shaped blind groove and correspond to the wiring terminal positioning holes of the socket base; an axial sealing cover positioning rib (4*b*5) is arranged on the inner wall of the weight-bearing beam hood; an open pin chute, a guiding groove and a lock tongue chute corresponding to the C-shaped weight-bearing beam are arranged on the side wall and a circular hole is formed in the bottom corresponding to the nailing through hole of the C-shaped weight-bearing beam; and all of the are exposed;

the weight-bearing lintel (4*c*) has a shape of square bracket; the inner-side distance of straight walls (4*c*l) on both sides corresponds to the width of the pin chute and can be abutted on the bulges on both sides; the external vertical surface (4*c*2) is inward; and the C-shaped weight-bearing beam is inserted into the weight-bearing beam hood and the weight-bearing lintel is rested against the bulges to form the weight-bearing ring beam.

5. The socket for the pendent lamp according to claim 1, wherein the wiring device (5) comprises a binding post (5*a*), a binding post top plate (5*b*), a soft conducting wire (5*c*), a wiring terminal (5*d*) in dual rectangular shape, as wire pressing spring (5*e*), a wiring clamping plate (5*f*), a wiring button (5*g*), a binding post bracket (5*h*) and a binding post slider (5*i*), characterized in that:

the binding post (5*a*) is a cylinder and is in slide fit with the binding post holes of the weight-bearing ring beam;

the binding post top plate (5*b*) is a circular sheet of which the external diameter is larger than that of the binding post, and is fixedly connected with the binding post;

a slot (5*d*1) is formed in the top end of the wiring terminal (5*d*) in dual rectangular shape, and is in conductive connection with the above binding post top plate through the soft conducting wire (5*c*); the wire pressing spring (5*c*) is placed in the wiring terminal in dual rectangular shape;

the main body of the wiring clamping plate (5*f*) is a square sheet, has a central hole (5*f*1) and bulges (5*f*2) on the top and the bottom, and is in movable fit with the slot in the top end of the wiring terminal in dual rectangular shape;

the wiring button (5*g*) can slide in the hollow column of the outer cavity of the aforementioned socket base, and the bottom thereof has an opening which can be embedded into the upper bulge of the wiring clamping plate;

the main body of the binding post bracket (5*h*) is an arc-shaped solid structure; two protruding ribs on the bottom surface form a chute (5*h*1); slots (5*h*2) are formed in both sides; a right-angled trapezoid lug boss (5*h*3) is arranged on the top surface; the binding post bracket can freely slide in the arc-shaped blind groove of the weight-bearing ring beam of the socket, and the slots in both sides can press against the above-mentioned binding post top plate; and the main body of the binding post slider (5*i*) is a rectangular parallelepiped; a trapezoid bulge (5*i*1) is arranged on the front part of the bottom surface; a positioning groove (5*i*2) is formed in the top surface; and a cylinder (5*i*3) is arranged on the back side surface; the binding post slider can slide in the binding post slider slideway of the aforementioned socket base and is matched and positioned through the positioning groove on the top and the bulge in the chute.

6. A weight-bearing plug for a pendent lamp, comprising a junction box (10), a weight-hearing bottom plate (11), to plug weight-bearing ring beam (12) and an unlocking component (13), characterized in that:

a central hole (10*b*1) is formed in the bottom of the junction box (10); two wiring vertical columns (10*d*) and balance vertical columns (10*c*) which are in balance with the wiring vertical columns (10*d*) are exposed from a box cover; as nailing hole (10*a*7) is formed in the junction box; a wiring terminal (10*e*) is placed in the junction box and is in conductive connection with the above-mentioned wiring vertical column;

the weight-bearing bottom plate (11) is in cross shape and has a central hole (1101), wherein the central hole comprises a flange; the external diameter of the flange and the internal diameter of the central hole of the above-mentioned junction box are in insertion fit; the outer end is made to bend in Z shape, and a threaded hole (1102) is formed: the weight-hearing bottom plate can be placed in the junction box;

the plug weight-bearing ring beam (12) comprises a radial inner wall inverted inner and outer arcs are formed along the circumferential direction on the top of the plug weight-bearing ring beam (12), and an insertion positioning groove (12*b*1) is formed in the outer arc; a circular hole (12*b*2) is formed in the outer side wall which is same-radial opposite to the insertion positioning groove; a pair of opposite pin clamping grooves (12*a*1) with openings on the bottom are drawn from the radial inner wall vertical to the central line of the insertion positioning groove and are matched with the weight-bearing pin (3) of the weight-bearing socket of claim 1, wherein the pin clamping grooves (12*a*1) comprise side walls; the side walls of the pin clamping grooves are respectively stretched outwards to form reversely symmetrical ramps (12*a*2); a lock tongue clamping groove (12*a*6) with an opening on the bottom is formed in the inner wall which is same-radial opposite to the insertion positioning groove and is in clearance fit with a lock tongue of the aforementioned socket; nailing holes (12*a*7) are made in the circumferential direction of the above-mentioned plug weight-bearing ring beam and correspond to the nailing hole of the above-mentioned junction box; and a freely sliding lock core (13*b*) is placed in a lock core sleeve (13*a*) of the unlocking component (13), and the unlocking component can be placed in the circular hole of the outer side wall of the plug weight-bearing ring beam.

7. The plug for the pendent lamp according to claim 6, wherein the junction box (10) comprises a box cover (10*a*), a box body (10*b*), a balance vertical column (10*c*), a wiring vertical column (10*d*) and a wiring terminal (10*e*), characterized in that:

the box cover (10*a*) of the junction box has the shape of a circular ring; a positioning rib (10*a*1) is arranged on the box cover; a diametrical box cover assembling hole (10*a*2) is formed in the outer side of the positioning rib; a balance vertical column guiding sleeve and a hole (10*a*3), and a wiring vertical column guiding sleeve and a hole (10*a*4) are respectively formed in both sides of the central line of the assembling hole; symmetrical wiring terminal positioning ribs (10*a*5) are arranged on the circumference in the box cover, and a semicircular threading groove is also formed; the central lines of the positioning ribs are perpendicular to the central line of the above-mentioned assembling hole; wiring screw holes (10*a*6) are formed in the outer sides of the positioning ribs; a nailing hole (10*a*7) is formed in the box cover;

the box body (10*b*) of the junction box is an open housing; a central hole (10*b*1) is formed in the bottom; a diametrical lug boss (10*b*2) of a threaded hole or through hole is arranged inside; a balance vertical column depression (10*b*3) and a wiring vertical column depression (10*h*4) are respectively arranged on both sides of the central line of the lug boss and respectively correspond to the diametrical assembling hole of the above-mentioned box cover, the balance vertical column guiding sleeve and the wiring vertical column guiding sleeve; symmetrical wiring terminal fixing ribs (10*b*5) are arranged on the radial line perpendicular to the central line of the above-mentioned diametrical lug boss, and a semicircular threading groove is also formed, corresponding to the wiring terminal positioning ribs of the above-mentioned box cover and the semicircular threading groove thereof;

the outer side of the outer wall of the box body is subject to axial tension to form annular steps (10*b*6); and the balance vertical column (10*c*) is formed by superposing different-diameter cylinders and is in movable fit with the balance vertical column guiding sleeve of the above-mentioned box cover and the hole;

the wiring vertical column (10*d*) is formed by superposing different-diameter cylinders and is in movable fit with the wiring vertical column guiding sleeve of the above-mentioned box cover and the hole; and the wiring terminal (10*e*) is a rectangular parallelepiped: a threading hole (10*e*1) is formed in the vertical surface of the front side; a wiring screw (10*e*2) is arranged on the top surface and corresponds to the wiring screw hole on the above-mentioned box cover; and the wiring terminal and the wiring vertical column are in conductive connection.

8. The plug for the pendent lamp according to claim 6, wherein the plug weight-bearing ring beam (12) comprises a ring beam skeleton (12*a*) and a ring beam skeleton hood (12*b*), characterized in that:

the main body of the ring beam skeleton (12*a*) is an annular body; radially-symmetrical bulges are arranged on the annular body; a pair of opposite pin clamping grooves (12*a*1) with openings on the bottom are drawn from the inner side and are matched with the weight-bearing pin in the aforementioned socket; the side walls of the pin clamping grooves are respectively stretched outwards to form reversely symmetrical ramps (12*a*2); protruding ribs are arranged on the tops of the bulges and threaded holes (12*a*3) are drilled;

an arc-shaped bulge is arranged on the radial line perpendicular to the central lines of the above-mentioned pin clamping grooves on the annular body; the inner part of the arc-shaped bulge is sucked to be a cavity (12*a*4); a circular hole (12*a*5) is formed in the outer side wall; a lock tongue clamping groove (12*a*6) with an opening on the bottom is formed in the inner wall and is in clearance fit with a lock tongue of the aforementioned socket;

nailing through holes (12*a*7) are made in the circumferential direction of the annular body and correspond to the nailing hole of the above-mentioned box cover; an arc positioning lug boss (12*a*8) is arranged on the bottom of the annular body and is in insertion fit with the annular steps of the above-mentioned box body;

inverted inner and outer arcs are formed along the circumferential direction on the top of the ring beam skeleton hood (12*b*), and an insertion positioning groove (12*b*1) is formed in the outer arc; a circular hole (12*b*2) is drilled in the outer wall which is same-radial opposite to the insertion positioning groove, and corresponds to the circular hole in the outer side wail of the arc-shaped bulge of the above-mentioned ring beam skeleton; the inner wall is open so that the lock tongue clamping groove of the above-mentioned ring beam skeleton is exposed;

a diametrical countersunk through hole (12*b*3) is made in the radial top perpendicular to the insertion positioning groove and corresponds to the threaded hole of the protruding ribs of the above-mentioned ring beam skeleton; the inner wall is open so that the pin clamping groove of the above-mentioned ring beam skeleton and the ramps are exposed; a diametrical rotating positioning frustum (12*b*4) is arranged on the same-radial top of the insertion positioning, groove; and after the ring beam skeleton is pressed into the ring beam skeleton hood, the plug weight-bearing ring beam is formed; the external diameter thereof is less than the internal diameter of the U-shaped arch of the aforementioned socket base; and the internal diameter thereof is greater than the external diameter of the aforementioned weight-bearing ring beam.

9. The plug for the pendent lamp according to claim 6, wherein the unlocking component (13) comprises a lock core sleeve (13*a*) and a lock core (13*b*), characterized in that:

the lock core sleeve (13*a*) is a thin wall hollow cylinder; one end is necked to form a contraction port (13*a*1); the lock core sleeve and the circular hole in the outer side wall of the arc-shaped bulge of the ring beam skeleton are in press fit; and the lock core (13*b*) is a variable diameter cylinder; the front-segment cylinder (13*b*1) is connected with a flange disc (13*b*2) and then connected with a central-segment cylinder (13*b*3); the diameter of the end-segment cylinder (13*b*4) is less than the diameter of the central-segment cylinder; and movable fit is made between the flange disc of the lock core and the lock core sleeve, between the front-segment cylinder and the contraction port and between the end-segment cylinder and the lock tongue clamping groove in the ring beam skeleton.

10. The plug for the pendent lamp according to claim 6, characterized in that: the unlocking, component is a lock handle (14); the main body of the lock handle is a square solid structure (1401); a cylinder (1402) is stretched from the bottom surface; the top surface and the left side are vacuumized to form an inner cavity; protruding ribs are arranged on the right side surface and have inverted bevels on the upper end; and the square solid structure and the protruding ribs can respectively slide in the cavity of the arc-shaped bulge of the aforementioned ring beam skeleton and the look tongue clamping groove.

* * * * *